US008313367B2

(12) United States Patent
Hamlin

(10) Patent No.: US 8,313,367 B2
(45) Date of Patent: Nov. 20, 2012

(54) GAMING SYSTEM HAVING CYCLING ELIGIBILITY FOR SUPPLEMENTAL FEATURES

(75) Inventor: Vernon W. Hamlin, Lisle, IL (US)

(73) Assignee: WMS Gaming Inc., Waukegan, IL (US)

( * ) Notice: Subject to any disclaimer, the term of this patent is extended or adjusted under 35 U.S.C. 154(b) by 189 days.

(21) Appl. No.: 12/738,485

(22) PCT Filed: Oct. 29, 2008

(86) PCT No.: PCT/US2008/012315

§ 371 (c)(1),
(2), (4) Date: Apr. 16, 2010

(87) PCT Pub. No.: WO2009/061365

PCT Pub. Date: May 14, 2009

(65) Prior Publication Data

US 2010/0216544 A1 Aug. 26, 2010

Related U.S. Application Data

(60) Provisional application No. 61/001,831, filed on Nov. 5, 2007.

(51) Int. Cl.
*A63F 9/24* (2006.01)

(52) U.S. Cl. ..... 463/16; 463/20; 463/25; 463/29

(58) Field of Classification Search ..... 463/16–20, 463/25–29

See application file for complete search history.

(56) References Cited

U.S. PATENT DOCUMENTS

| | | | | |
|---|---|---|---|---|
| 5,083,271 | A | 1/1992 | Thacher et al. | 341/411 |
| 5,655,961 | A | 8/1997 | Acres et al. | 463/27 |
| 5,761,649 | A | 6/1998 | Hill | 705/27 |
| 5,848,932 | A * | 12/1998 | Adams | 463/20 |
| 5,851,149 | A | 12/1998 | Xidos et al. | 463/42 |
| RE37,885 | E | 10/2002 | Acres et al. | 463/42 |
| 6,645,077 | B2 | 11/2003 | Rowe | 463/42 |
| RE38,812 | E | 10/2005 | Acres et al. | 463/26 |
| 7,144,321 | B2 | 12/2006 | Mayeroff | 463/16 |
| 7,278,919 | B2 | 10/2007 | Souza et al. | |

(Continued)

FOREIGN PATENT DOCUMENTS

AU 5251830 12/2005

(Continued)

OTHER PUBLICATIONS

Written Opinion corresponding to co-pending International Patent Application Serial No. PCT/US2008012315, United States Patent Office; dated Jan. 6, 2009; 4 pages.

(Continued)

*Primary Examiner* — Omkar Deodhar
(74) *Attorney, Agent, or Firm* — Nixon Peabody LLP

(57) ABSTRACT

A method of operating a wagering game comprises receiving a primary wager, receiving an activation input from a player, and in response thereto, activating an auto-cycle feature. The auto-cycle feature is associated with a plurality of supplemental features. The method further comprises activating a first period of eligibility for a first one of the plurality of supplemental features during a display of a first outcome of a primary wagering game, and activating a second period of eligibility for a second one of the plurality of supplemental features during a display of a second outcome of the primary wagering game.

25 Claims, 10 Drawing Sheets

U.S. PATENT DOCUMENTS

| | | | | |
|---|---|---|---|---|
| 7,285,049 | B1 | 10/2007 | Luciano, Jr. et al. | 463/42 |
| 7,914,377 | B2 | 3/2011 | Benbrahim et al. | 463/25 |
| 2002/0090990 | A1* | 7/2002 | Joshi et al. | 463/20 |
| 2005/0043092 | A1* | 2/2005 | Gauselmann | 463/36 |
| 2005/0282607 | A1* | 12/2005 | Gauselmann | 463/16 |
| 2006/0073887 | A1 | 4/2006 | Nguyen et al. | 463/27 |
| 2006/0073888 | A1 | 4/2006 | Nguyen et al. | 463/27 |
| 2006/0142079 | A1 | 6/2006 | Ikehara et al. | 463/27 |
| 2006/0287043 | A1* | 12/2006 | Englman et al. | 463/16 |
| 2007/0060314 | A1 | 3/2007 | Baerlocher et al. | 463/25 |
| 2007/0060321 | A1 | 3/2007 | Vasquez et al. | 463/27 |
| 2007/0135193 | A1 | 6/2007 | Nicely | |
| 2007/0191088 | A1 | 8/2007 | Breckner et al. | 463/20 |
| 2007/0218975 | A1 | 9/2007 | Iddings et al. | 463/25 |
| 2007/0225065 | A1 | 9/2007 | Wright et al. | 463/25 |
| 2007/0259709 | A1 | 11/2007 | Kelly et al. | 463/20 |
| 2007/0293293 | A1 | 12/2007 | Baerlocher et al. | 463/16 |
| 2007/0298857 | A1 | 12/2007 | Schlottmann et al. | 463/16 |
| 2007/0298874 | A1 | 12/2007 | Baerlocher et al. | 463/27 |
| 2007/0298875 | A1 | 12/2007 | Baerlocher et al. | 463/27 |
| 2008/0020830 | A1 | 1/2008 | Ikehara et al. | 463/27 |
| 2008/0020831 | A1 | 1/2008 | Ikehara et al. | 463/27 |
| 2008/0020832 | A1 | 1/2008 | Iddings et al. | 463/27 |
| 2008/0020833 | A1 | 1/2008 | Baerlocher et al. | 463/27 |
| 2008/0020834 | A1 | 1/2008 | Breckner et al. | 463/27 |
| 2008/0020846 | A1 | 1/2008 | Vasquez et al. | 463/42 |
| 2008/0045344 | A1 | 2/2008 | Schlottmann et al. | 463/42 |
| 2008/0064502 | A1 | 3/2008 | Schlottmann et al. | 463/42 |
| 2008/0070680 | A1 | 3/2008 | Baerlocher et al. | 463/27 |
| 2008/0070692 | A1 | 3/2008 | Schlottmann et al. | 463/42 |
| 2008/0070693 | A1 | 3/2008 | Schlottmann et al. | 463/42 |
| 2008/0070694 | A1 | 3/2008 | Schlottmann et al. | 463/42 |
| 2008/0070695 | A1 | 3/2008 | Baerlocher et al. | 463/42 |
| 2008/0076514 | A1 | 3/2008 | Baerlocher et al. | 463/20 |
| 2008/0076515 | A1 | 3/2008 | Baerlocher et al. | 463/20 |
| 2008/0076517 | A1 | 3/2008 | Baerlocher et al. | 463/20 |
| 2008/0076552 | A1 | 3/2008 | Baerlocher et al. | 463/31 |

FOREIGN PATENT DOCUMENTS

| | | | |
|---|---|---|---|
| WO | WO 2005/120672 | A2 | 12/2005 |
| WO | WO 2006/076185 | A2 | 7/2006 |
| WO | 2007/139874 | A2 | 12/2007 |
| WO | 2007/139988 | A2 | 12/2007 |
| WO | 2008/033392 | A2 | 3/2008 |
| WO | WO 2008/030904 | A2 | 3/2008 |
| WO | 2008/060426 | A2 | 5/2008 |
| WO | 2008/060429 | A2 | 5/2008 |
| WO | 2008/060442 | A2 | 5/2008 |
| WO | 2008/060459 | A2 | 5/2008 |
| WO | 2008/060513 | A2 | 5/2008 |
| WO | 2008/063408 | A2 | 5/2008 |
| WO | 2009/011833 | A2 | 1/2009 |

OTHER PUBLICATIONS

International Search Report corresponding to co-pending International Patent Application Serial No. PCT/US2008/012315, United States Patent Office; dated Jan. 6, 2009; 2 pages.

* cited by examiner

GAMING SYSTEM HAVING CYCLING ELIGIBILITY FOR SUPPLEMENTAL FEATURES

CLAIM OF PRIORITY AND CROSS-REFERENCE TO RELATED APPLICATIONS

This application is a U.S. National Phase of International Application No. PCT/US2008/012315, filed on Oct. 29, 2008, which claims the benefit of and priority to U.S. Provisional Patent Application No. 61/001,831, filed on Nov. 5, 2007, both of which are incorporated herein by reference in their entireties.

FIELD OF THE INVENTION

The present invention relates generally to gaming machines, and methods for playing wagering games, and more particularly, to a gaming system having cycling eligibility for supplemental features.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

SUMMARY OF THE INVENTION

According to one aspect of the present invention, a method of operating a wagering game comprises receiving a primary wager, receiving an activation input from a player, and in response thereto, activating an auto-cycle feature. The auto-cycle feature is associated with a plurality of supplemental features. The method further comprises activating a first period of eligibility for a first one of the plurality of supplemental features during a display of a first outcome of a primary wagering game, and activating a second period of eligibility for a second one of the plurality of supplemental features during a display of a second outcome of the primary wagering game.

According to another aspect of the invention, a gaming system comprises a wager input device and at least one display for displaying a primary wagering game and a plurality of available supplemental feature icons. The system further comprises at least one controller operative to (i) detect an input selection for activating an auto-cycle feature, and in response thereto, activate the auto-cycle feature, (ii) during a first subsequent play of the primary wagering game, activate a first eligibility period for a first supplemental feature associated with the auto-cycle feature, (iii) during a second subsequent play of the primary wagering game, activate a second eligibility period for a second supplemental feature associated with the auto-cycle feature, (iv) in response to a first triggering event occurring during the first eligibility period, initiate the first supplemental feature, and (v) in response to a second trigging event occurring during the second eligibility period, initiate the second supplemental feature.

According to yet another aspect of the invention, a method of cycling eligibility for supplemental features comprises receiving a first input selection from a player to activate an auto-cycle feature and in response to receiving the input selection, activating operation of the auto-cycle feature. The method further comprises, during operation of the auto-cycle feature, cycling periods of eligibility amongst a plurality of supplemental features associated with the auto-cycle feature.

According to yet another aspect of the invention, a method of operating a wagering game comprises receiving a primary wager and activating a first auto-cycle feature, the auto-cycle feature associated with a first set of supplemental features. The method further comprises, during operation of the first auto-cycle feature, cycling periods of eligibility amongst the first set of supplemental features. The method further comprises activating a second auto-cycle feature, the second auto-cycle feature associated with a second set of supplemental features, and during operation of the second auto-cycle feature, cycling period of eligibility amongst the second set of supplemental features.

According to yet another aspect of the invention, a computer readable storage medium is encoded with instructions for directing a gaming system to perform the above method.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
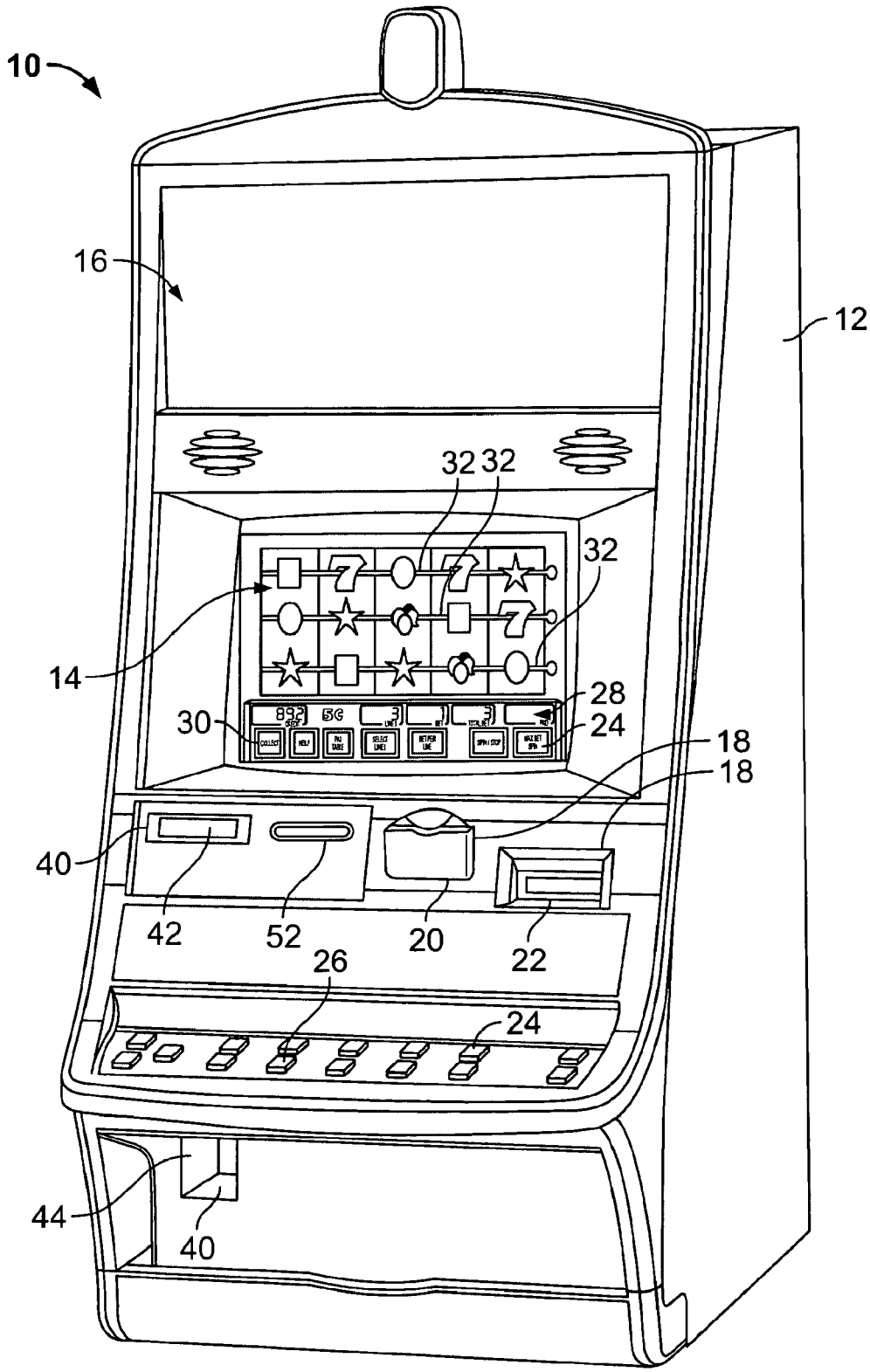
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a,* a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a,* or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
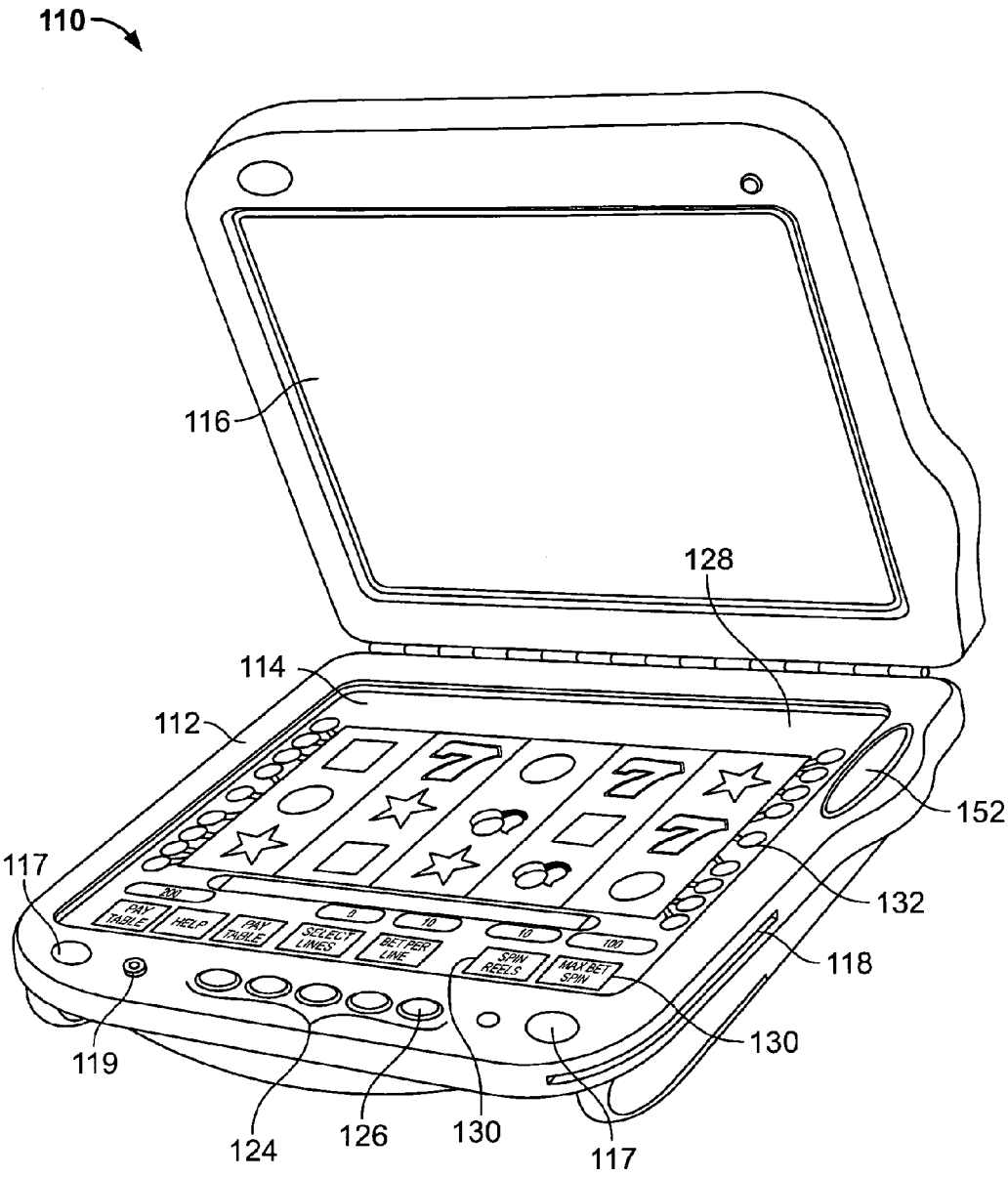
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
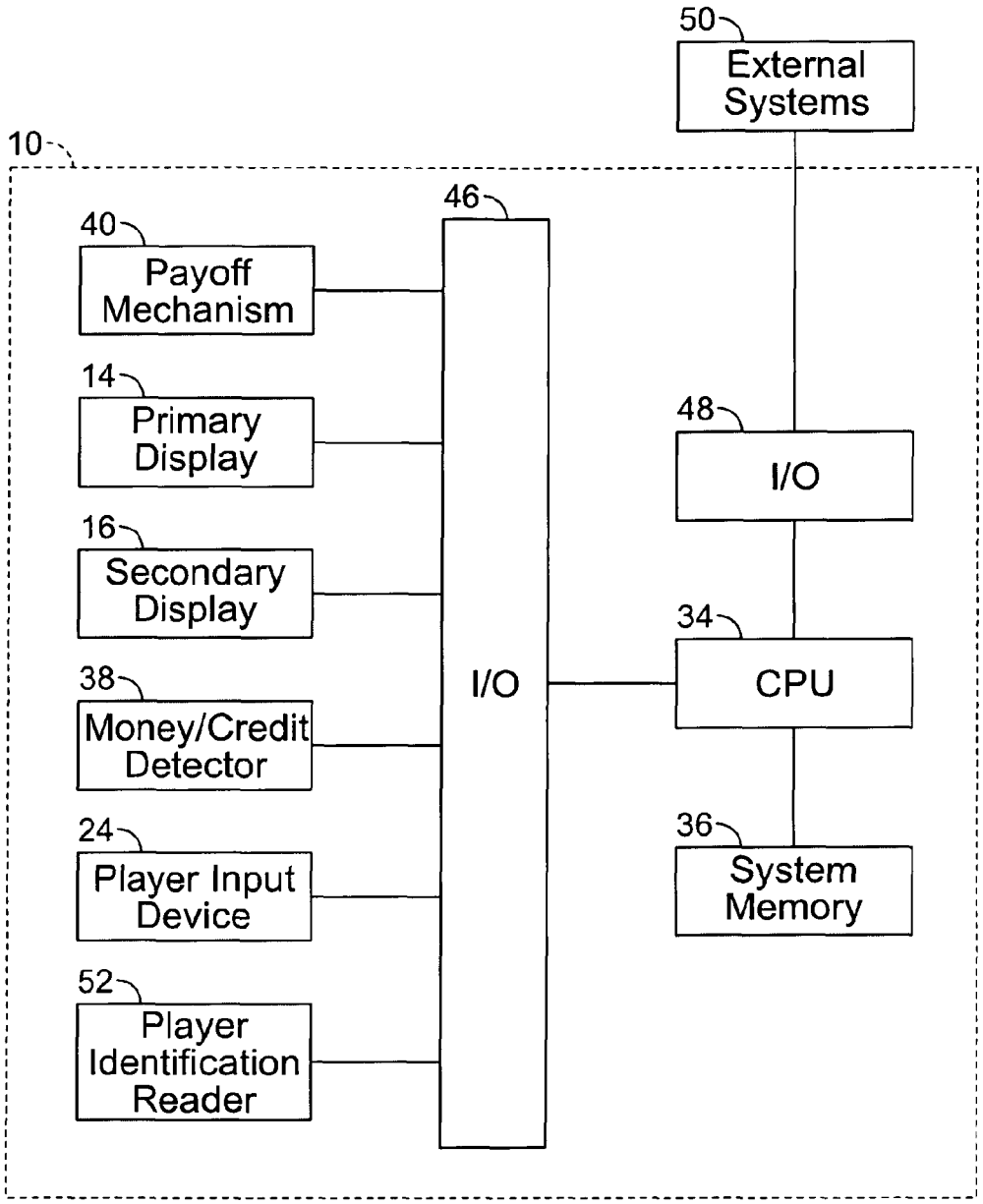
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
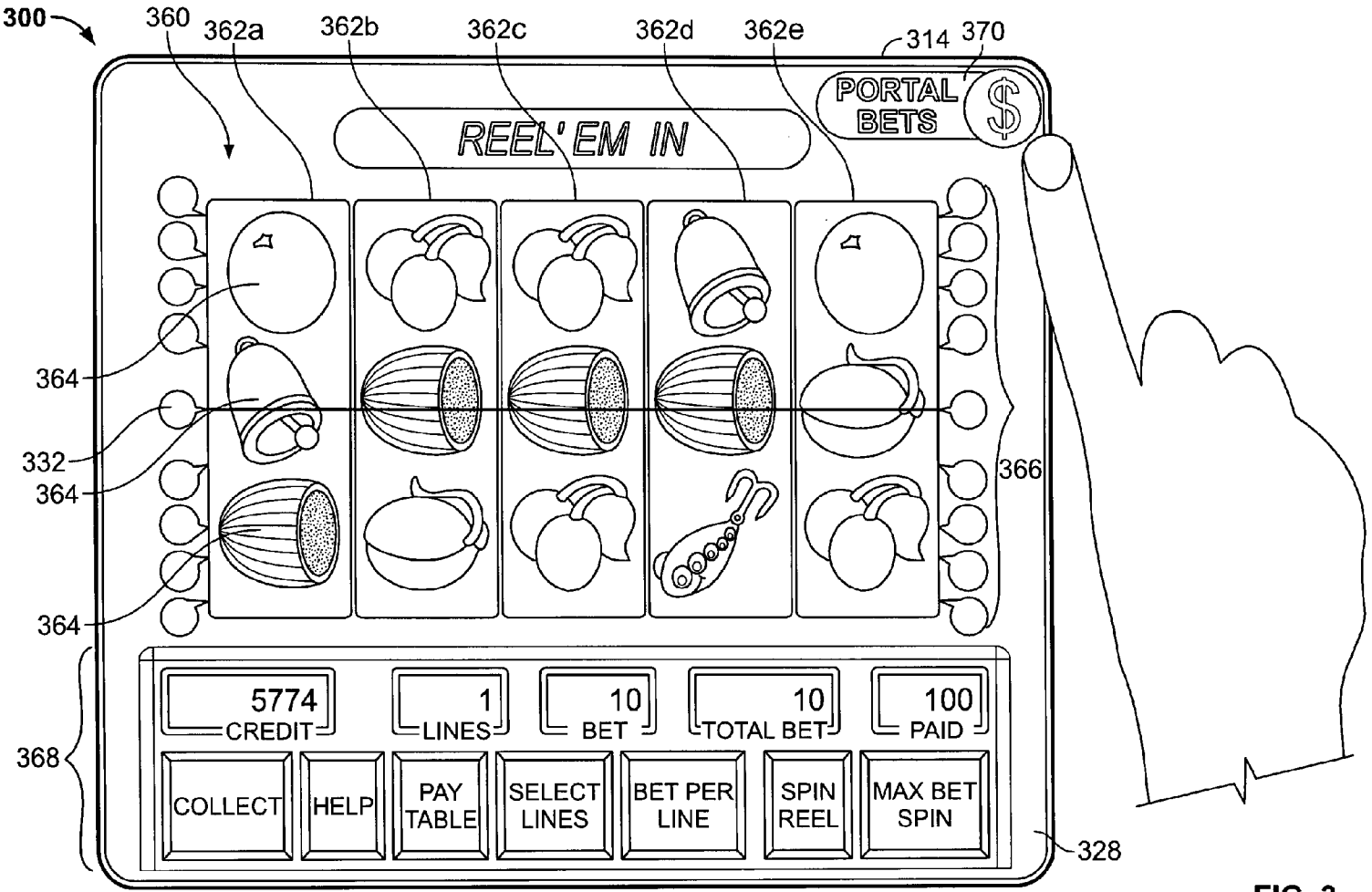
FIG. 3 is a screen shot of a primary display of a gaming system including a feature icon for activating eligibility for supplemental features.

Turning now to FIG. 3, a primary display 314 of a gaming system 300 is shown. The primary display 314 may be any form of display such as those described herein with reference to the free standing and handheld gaming devices of FIGS. 1*a* and 1*b*. The primary display 314 includes display of a primary wagering game 360, which in this embodiment is a slot game as shown in FIG. 3. The slot game 360 includes a plurality of reels 362*a,b,c,d,e* which may be either electro-mechanical reels or simulations thereof on the primary display 314. The reels 362*a,b,c,d,e* include a plurality of symbols 364 displayed thereon which vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol, or empty space. As described herein the symbols 364 landing on the active paylines 332 (the paylines for which a wager has been received) are evaluated for winning combinations. If a winning combination of symbols 364 lands on an active payline 332 a primary award is awarded in accordance with a pay table of the gaming device. The symbols 364 on the reels 362*a,b,c,d,e* form an array 366 or matrix of symbols 364, having a number of rows and columns, which in the embodiment shown is three rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

The primary display 314 further includes a control bar 368 along a bottom edge of the display 314. The control bar 368 displays a plurality of meters, such as a credit meter, a lines meter, a bet meter, a total bet meter and a paid meter. The control bar 368 further displays a plurality of input keys or soft touch keys with which a player interacts with the system 300. The input keys include a Collect key, a Help key, a Paytable key, a Select Lines key, a Bet Per Line key, a Spin Reel key and a Max Bet Spin key. Player inputs entered into the input keys of the control bar 368 are sensed via a touch screen 328 overlying the primary display 314. In this way, a player of the gaming system 300 can touch appropriate input keys to provide player selections, configuration inputs, and other inputs into the system 300 related to game play.

The system 300 further includes a feature icon 370 for displaying and receiving selection and activation of various supplemental or bonus features to the wagering game 360. The feature icon 370 in FIG. 3 comprises a graphical icon or button entitled "Portal Bets." In other embodiments, other icons or graphics may be utilized, and may include isolated buttons, icons, or even a graphical bar or menu, for example across the top, bottom, or side of the display 314. The feature icon 370 can be selected or activated by a player of the wagering game 360 through a touch screen 328 overlying the display 314, or through any other appropriate player input device as described herein with relation to FIGS. 1*a*, 1*b* and 2. In FIG. 3, the player is seen activating the feature icon 370 by selecting it via the touch screen 328.

Figure 4:
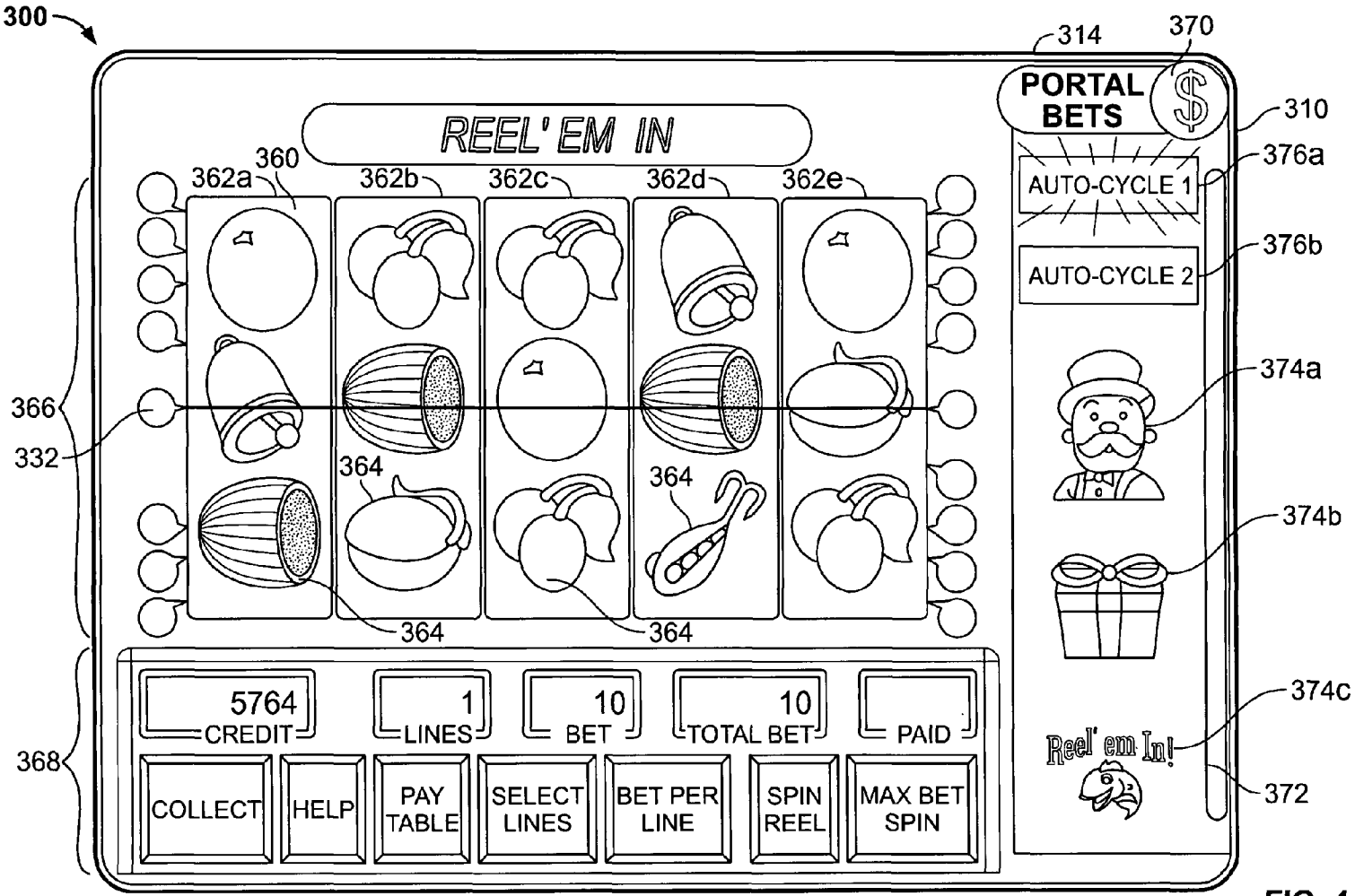
FIG. 4 is a screen shot of the primary display of FIG. 3 including a feature menu displaying activatable supplemental features auto-cycle modes.

Turning to FIG. 4, once the feature icon 370 has been selected or activated, a feature menu 372 is displayed on the primary display 314 of the system 300. The feature menu 372 includes a plurality of available bonus features 374 which are provided for activation or selection in addition to the primary wagering game 360. The feature menu 372 further includes a plurality of auto-cycle features 376. In FIG. 4, three available features 374*a,b,c* are shown which correspond to three different themed features, a Monopoly feature 374*a*, a Jackpot Party feature 374*b*, and a Reel 'Em In feature 374*c*. Any one or more of the features 374*a,b,c* displayed may be activated by a player, in this embodiment, by touching the touch screen 328 at an appropriate location to select the desired feature or features 374*a,b,c*. In an embodiment, selection and activation of one of the features 374 requires input of an additional or supplemental wager in the form of a secondary wager, side bet, or other monetary input. Thus, in one embodiment, selection of a desired feature 374 causes a player's wager account (credit meter on the control bar 368) to be debited in an appropriate amount associated with the feature. By selecting the desired feature 374 and paying the side wager, the player is eligible to play the desired feature 374 should it be triggered during the period of his eligibility. In one embodiment, one side wager on a desired feature 374 causes the player to be eligible for one play of the primary wagering game 360. In an alternative embodiment, one or more of the features 374 may be activated or selected without placing additional wagers or incurring additional fees. In yet another alternative embodiment, the cost of additional features 374 may be debited from or supplied by player loyalty points, frequent player points, comps, player tracking card points, a designated feature fund, or other collected secondary economy accounts, instead of or in addition to currency wagers.

In addition, the feature menu 372 includes a menu controller for scrolling through visible and obscured selections. In this embodiment, the menu controller is a scroll bar or slider bar depicted on the right edge of the feature menu 372. For example, when the feature icon 370 is first selected, some of the plurality of available features 374 are displayed while others are obscured as being lower in the feature menu 372 window. The slider bar may be utilized to scroll or slide down within the window of the feature menu 372 so as to reveal previously obscured features 374 which are available. In alternative embodiments, many other menu controllers may be utilized instead of or in addition to the scroll bar. For example, the menu controller may comprise a knob, wheel, joystick, or other physical controller such as Up and Down arrows or keys. Moreover, the menu controller may comprise soft key equivalents of these physical devices, such as a virtual knob, dial, page up button, page down button, arrows, wheels, roller balls, etc. which receive inputs through the touch screen 328 controlling movement of the features 374 in the feature menu 372.

In the embodiment shown in the FIGURES, by "activating" a feature 374, a player activates eligibility for the feature 374 should it be triggered. As explained, activation of one or more of the features 374 requires the placement of a side wager debited from the player's credit balance. The features 374 available for activation may take on many different forms, and are available to players in addition to one or more basic wagering games 360 of the system 300. Any number of wagering game features 374 may be made available to be activated by a player of the gaming system 300. The features 374 may include any number of improvements, additions, enhancements, or modifications of a standard basic wagering game experience displayed on the primary display 314. For example, the features 374 may include eligibility or participation in bonus games, progressive jackpots or awards, community games or events, including group games, team competitions, and competitive or collaborative play. The features 374 may also include wagering game assets such as free spins, wild symbols, multipliers, symbol upgrades, expanding wild symbols, scatter symbols, etc. The features 374 may also include eligibility or participation in secondary wagering games, side-bet games, reel re-spins, or extra chances or opportunities during play of the primary wagering games.

In other embodiments, the features 374 which may be activated may include features usable in a selection game, such as additional selections, opportunities to replace or re-do a prior selection, opportunities to undo a poor selection or selection of a terminating symbol, etc. Moreover, the features 374 may include eligibility or participation in enhanced awards, improvements of randomly selected outcomes of a primary wagering game, advancement to higher levels of play, advancement to newer or more favorable episodes of wagering games, etc. In yet other embodiments, features 374 may include eligibility and participation in additional wagering games, other games within a casino or gaming establishment (e.g. other table games or electronic games), wide area progressive jackpots, local area progressive jackpots, tangible prize awards, player reward points and loyalty programs, etc. The features 374 of the gaming system 300 as described herein may comprise any feature available on a wagering game which may be funded by an increased wager, a side wager, a secondary or separate wager, via player reward points, or in any other manner utilizing any form of currency, monetary input or other value.

It should also be understood that the features 374 activated in the system 300 of the present invention may be any number of available wagering game features as described herein. Moreover, the features 374 may include any enhancements or additions to the primary wagering game as described in detail in U.S. Patent Application Ser. No. 60/844,032 filed on Sep. 12, 2006, and U.S. Patent Application Ser. No. 60/802,984 filed on May 24, 2006, both of which are assigned to WMS Gaming Inc. Both such applications are hereby incorporated by reference, in their entirety, as if full set forth herein.

When the feature icon 370 is selected and the feature menu 372 appears, the display of the primary wagering game 360 may be altered or adjusted so as to accommodate the presence of the feature menu 372. In FIG. 4, for example, the randomly selected outcome of the primary wagering game 360 has been reduced in size, as compared to its original presentation in FIG. 3. The adjustment of the primary wagering game 360 may take on many forms. For example, the primary wagering game 360 may be resized, by either increasing the size or reducing the size of the wagering game 360 on the primary display 314. Adjustments in size may be done so as to preserve the aspect ratio of the wagering game 360 (for example, the reduction from FIG. 3 to FIG. 4). In an alternative embodiment, the aspect ratio of the primary wagering game 360 may be altered, for example, by keeping the height of the wagering game 360 the same, and reducing or enlarging the width of the display of the primary wagering game 360, or vice versa, by adjusting the height while fixing the width. In yet another alternative embodiment, the wagering game 360 may be moved on the primary display 314 to provide additional screen room for the feature menu 372. Other adjustment techniques are possible so as to provide additional room on the display 314 for the feature menu 372. Combinations of two or more of these adjustment techniques may also be utilized.

The auto-cycle features 376*a,b* on the feature menu 372 may be used to allow a player to select a pattern or combination of features 374 without having to manually select or change selections of active features 374 in between plays of the primary wagering game 360. Thus, in an embodiment, an auto-cycle feature 376 is configured, programmed, and stored into appropriate memory of the system 300, where it can be selected and activated by a player. In an embodiment, the configuration of the various auto-cycle features 376*a,b* may be performed by an operator of the system 300, such as a casino, or in alternative embodiments, configuration of the auto-cycle features 376 may be performed by a player of wagering games 360 on the system 300.

In FIG. 4, a first auto-cycle feature 376*a* is configured so as to cycle eligibility of a player among a plurality of associated supplemental features 374. Thus, the first auto-cycle feature 376*a* in this embodiment is associated with the Monopoly feature 374*a,* the Jackpot Party feature 374*b,* and the Reel 'Em In feature 374*c* displayed on the feature menu 372. A player of the system 300 has selected the first auto-cycle feature 376*a* which is thus displayed as illuminated or highlighted on the menu 372. Once the first auto-cycle feature 376*a* is activated, it begins cycling eligibility through the plurality of features 374*a,b,c* with which it is associated, successively activating eligibility in the next feature 374*a,b,c* in the cycle on successive plays of the primary wagering game 360.

Figure 5:
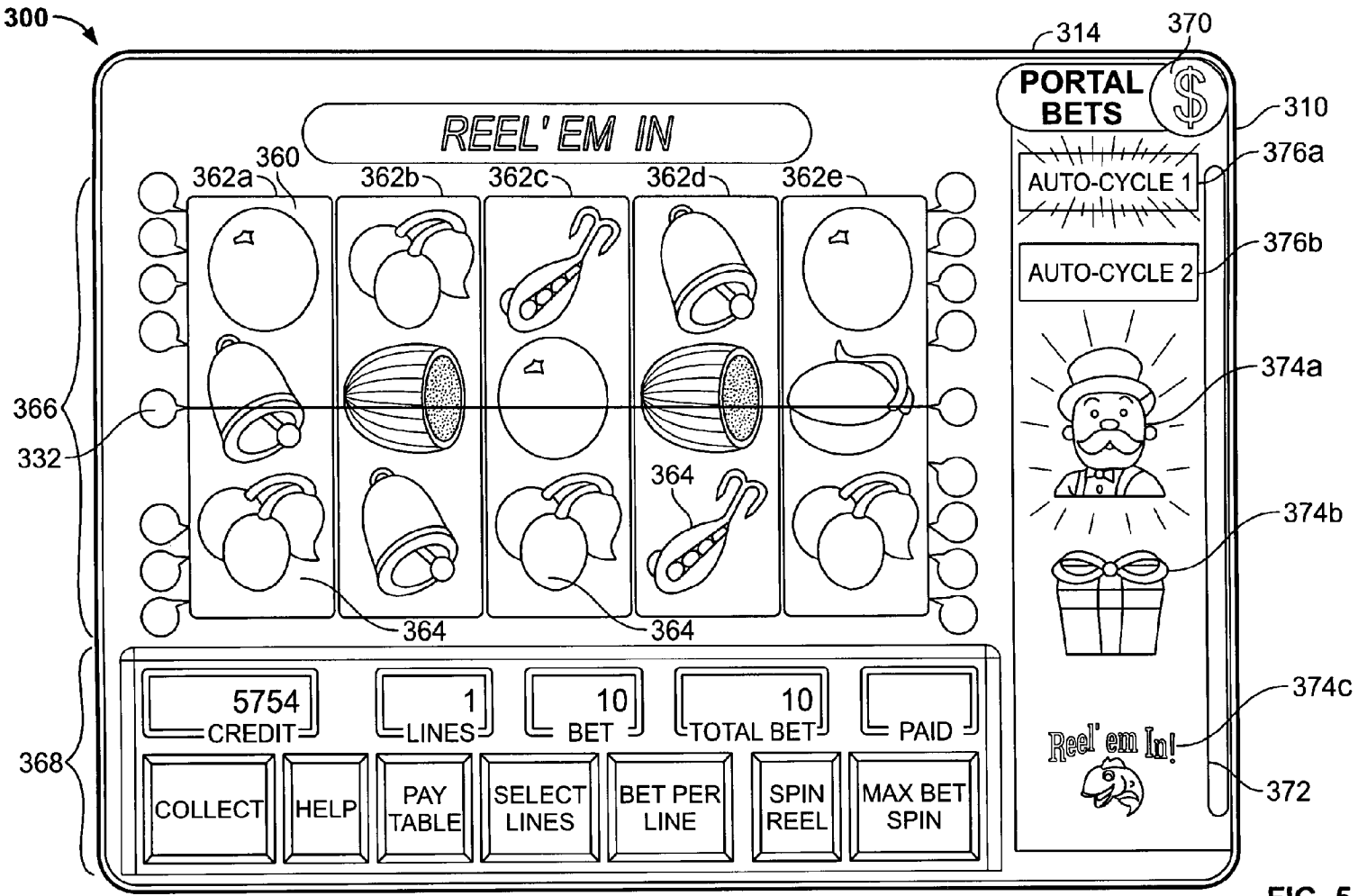
FIG. 5 is a screen shot of a primary display including a feature menu wherein a first auto-cycle mode activates eligibility for a first supplemental feature.

Thus, turning to FIG. 5, because the first auto-cycle feature 376*a* is activated, a player's eligibility for a first feature 374*a* of the auto-cycle is activated and shown as highlighted. On this particular spin of the reels of the primary wagering game 360, eligibility for the Monopoly feature 374*a* is active. Should a triggering event occur which triggers the Monopoly feature 374*a,* the player would participate since that feature 374*a* is currently active. In an embodiment, this means that the player has paid the requisite side wager and is therefore eligible to participate in the feature 374*a* should it be triggered. If triggered, the triggered feature 374*a* may be displayed on the primary display 314, on a secondary display, or on a community display, such as an overhead display. As seen in FIG. 5, the outcome of the reels is not a winning combination of symbols, and thus the paid meter on the control bar 368 reflects zero credits won.

Figure 6:
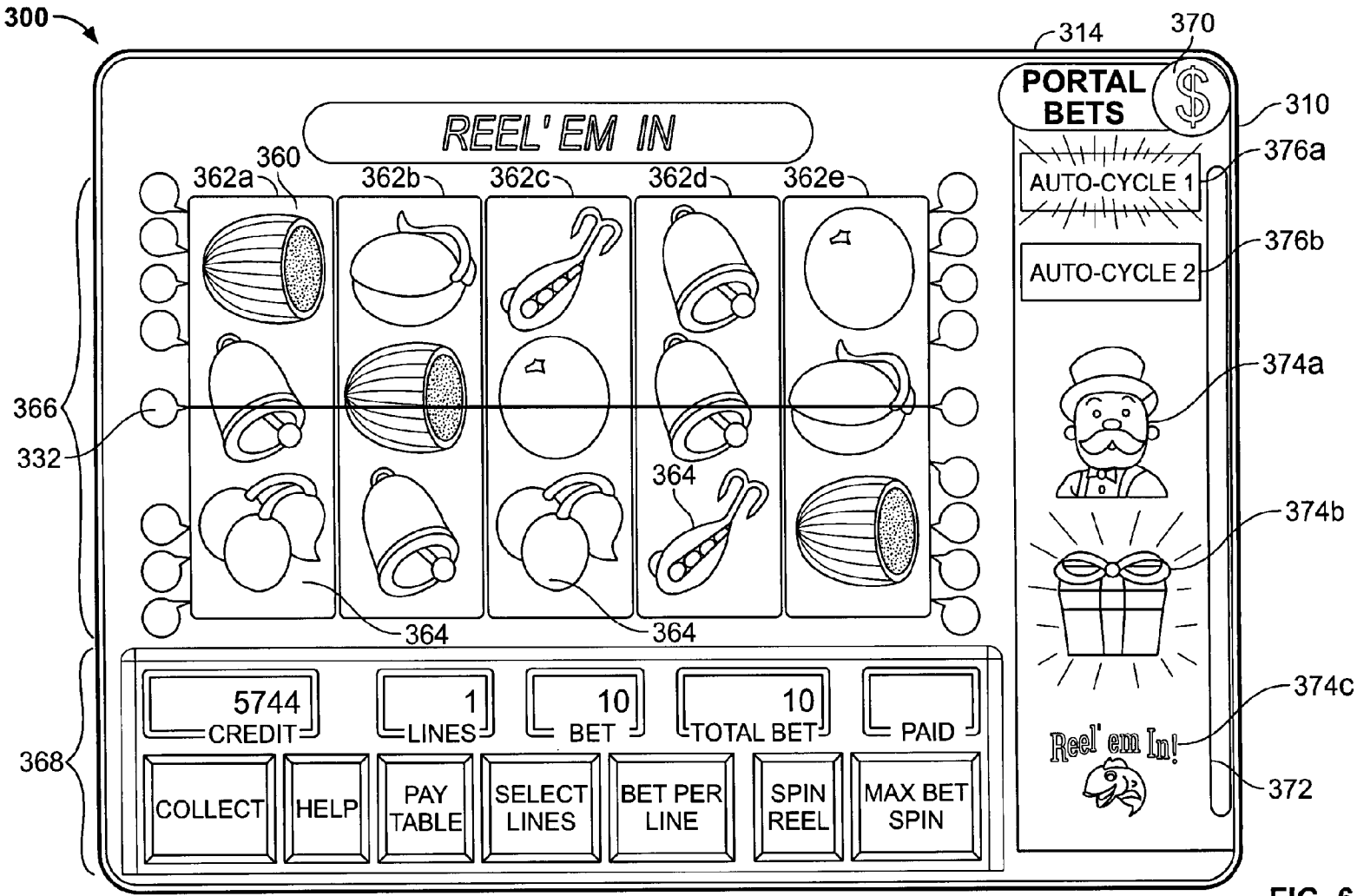
FIG. 6 is a further screen shot of the primary display of FIG. 5, wherein the auto-cycle mode has advanced eligibility to another supplemental feature.

A subsequent spin of the primary wagering game 360 is shown in FIG. 6. Because a new play of the wagering game 360 is occurring, the active first auto-cycle feature 376*a* causes a change in eligibility from the previously active first supplemental feature 374*a* to eligibility for the second supplemental feature 374*b*. Thus, on this play of the wagering game 360, eligibility for the Monopoly feature 374*a* is deactivated and eligibility for the Jackpot Party feature 374*b* is now activated. During this play of the primary wagering game 360, if a triggering event for the Jackpot Party feature 374*b* were to occur, the player would participate in the feature 374*b* because of his current active eligibility status in the auto-cycle. Because eligibility for the Jackpot Party feature 374*b* is currently active in the auto-cycle, it is shown as illuminated or highlighted. On this play of the primary wagering game 360, the outcome of the reels is not a winning combination of symbols, and thus the paid meter on the control bar 368 reflects zero credits won.

Figure 7:
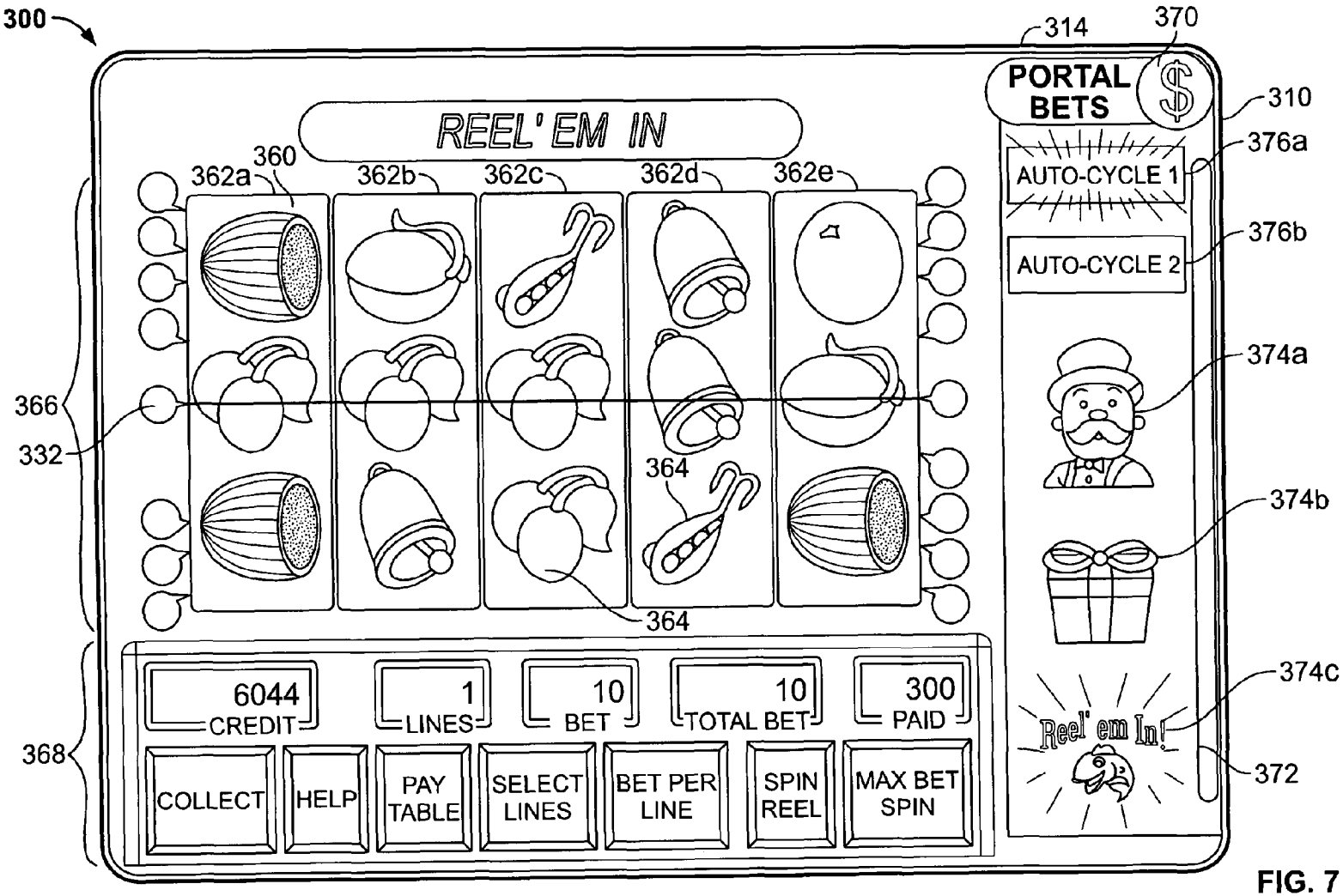
FIG. 7 is a further screen shot of the primary display of FIG. 5, wherein the auto-cycle mode has advanced eligibility to yet another supplemental feature.

Turning to FIG. 7, yet another subsequent play of the primary wagering game 360 is shown. The first auto-cycle feature 376*a* is still activated (shown highlighted) and thus it has once again cycled eligibility to the next supplemental feature 374*c* in the auto-cycle. In this case, eligibility for the Jackpot Party feature 374*b* has been deactivated and eligibility for the Reel 'Em In feature 374*c* is now shown as activated, and thus illuminated and highlighted in the feature menu 372. During this play of the primary wagering game 360, if a triggering event for the Reel 'Em In feature 374*c* were to occur, the player would be eligible to participate in the feature 374*c* because of its currently active eligibility status in the auto-cycle. On this play of the primary wagering game 360, a winning combination has occurred on the reels (three cherry symbols on an active payline 332) and thus an award is paid to the player (300 credits) as seen in the paid meter on the control bar 368.

Figure 8:
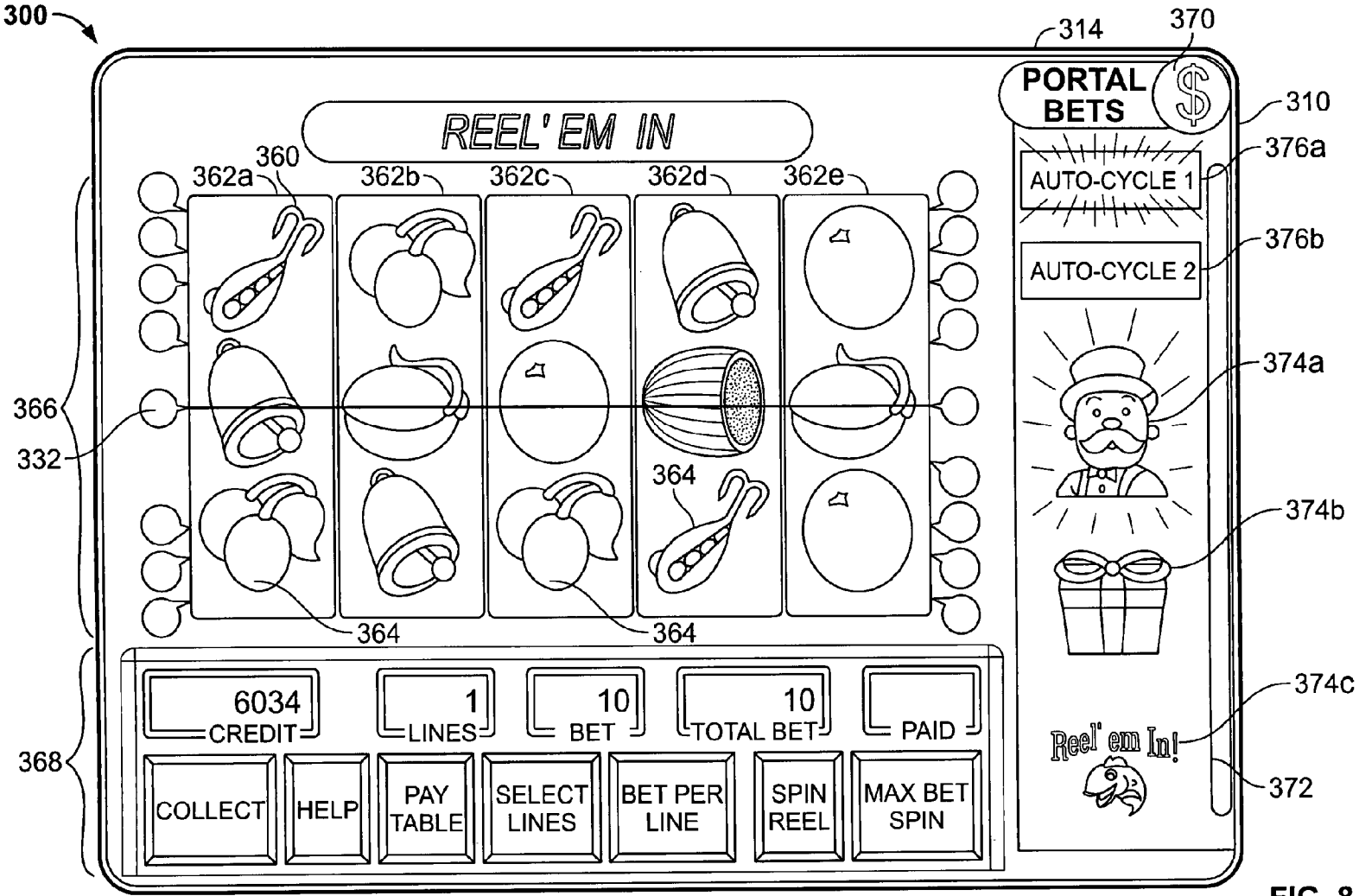
FIG. 8 is a further screen shot of the primary display of FIG. 5, wherein the auto-cycle mode has returned eligibility to the first supplemental feature.

Turning to FIG. 8, yet another subsequent play of the primary wagering game 360 is shown. The first auto-cycle feature 376*a* is still activated and has once again cycled eligibility to the next supplemental feature 374*a* in the auto-cycle. Because there are only three features 374*a,b,c* associated with the first auto-cycle feature 376*a,* the auto-cycle feature 376*a* returns to activate eligibility for the first feature 374*a*. Thus, on this play of the primary wagering game 360, eligibility for the Monopoly feature 374*a* is activated and shown as highlighted, while eligibility for the previous feature 374*c* in the cycle is deactivated. In this way, the auto-cycle feature 376*a* causes cycling of eligibility among the various features 374*a,b,c* associated with the auto-cycle 376*a* on successive plays of the primary wagering game 360. During this play of the primary wagering game 360, because eligibility for the Monopoly feature 374*a* is active again, if a triggering event for the Monopoly feature 374*a* occurs, the player will be permitted to participate in the triggered feature 374*a*.

Figure 9:
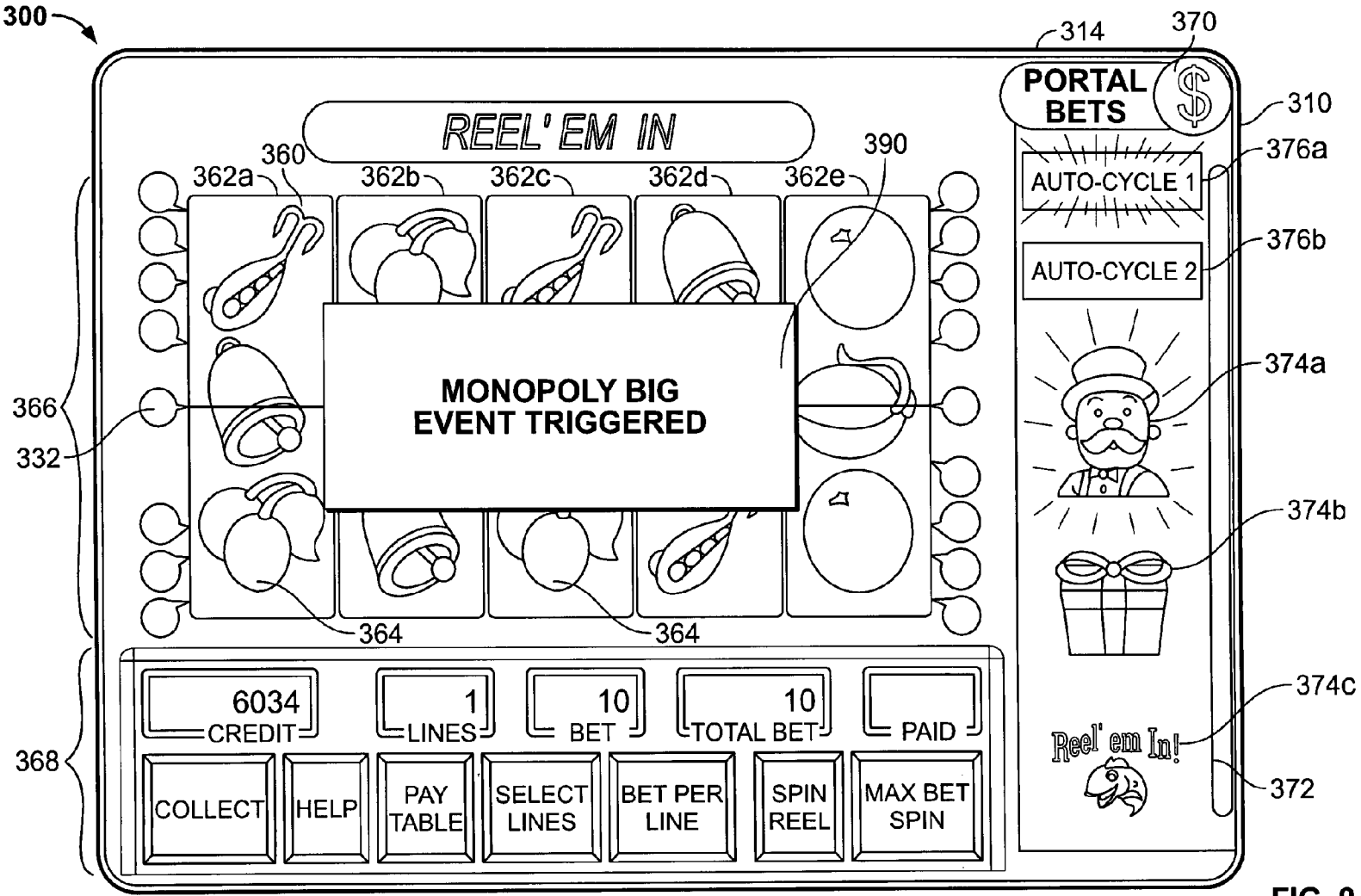
FIG. 9 is a further screen shot of the primary display of FIG. 5, wherein the first supplemental feature has been triggered.

In FIG. 9, a triggering event for the Monopoly feature 374*a* is shown. In this embodiment, the triggering event is a random selection or random event triggering the feature 374*a*. Because the first auto-cycle 376*a* was active and had in turn activated eligibility for the Monopoly feature 374*a* as the active feature for this play of the primary wagering game 360, the player is eligible for the feature 374*a* as triggered. A pop up window 390 is shown as an overlay to the primary wagering game 360. The pop up window 390 announces the occurrence of the relevant triggering event by stating "Monopoly Big Even Triggered." On the menu 372, eligibility for the Monopoly feature 374*a* is shown as active through illumination or highlighting, as is the auto-cycle feature 376*a*. Thus a player is able to visually comprehend that he is eligible to participate in the triggered feature 374*a* because eligibility for the triggered feature 374*a* is activated in the auto-cycle 376*a* at the time that the pop up window 390 announces the triggering event.

Thus, the auto-cycle feature 376*a* comprises a plurality of associated supplemental features 374*a,b,c* through which eligibility is cycled in the auto-cycle. As long as the auto-cycle feature 376*a* remains activated, it causes cycling of eligibility from one active supplemental feature 374 to the next on successive plays of the primary wagering game 360. Thus, when activated, the auto-cycle feature 376*a* activates eligibility for a first supplemental feature 374*a* for the next play of the wagering game 360. A player may then continue to play successive plays of the primary wagering game 360 by pressing the spin button on the control bar 368. Because the first auto-cycle feature 376*a* remains active, eligibility cycles from a first feature 374*a* to a second feature 374*b* to a third feature 374*c* and finally back to a first feature 374*a* as shown in the FIGURES. Thus, in an embodiment, the auto-cycle feature 376*a* causes successive changes in eligibility among the associated supplemental features 374 in a predetermined pattern associated with the auto-cycle 376*a*.

The auto-cycle features 376 provide players with a way to "sample" different available supplemental features 374. Players, particularly inexperienced players, may be hesitant to simultaneously activate eligibility for two, three, four or more supplemental features 374. One problem with doing so is that for supplemental features 374 which require side wagers or supplemental wagers to activate eligibility, a player can perceive simultaneous activation of multiple supplemental features 374 as an expensive proposition. This may cause players to avoid trying eligibility for various features 374 because of the associated apprehension. The auto-cycle feature 376 lessens the apprehension associated with sampling of supplemental features 374 because the cycling of eligibility in the features 374 therein provides players with the benefit of sampling and experiencing a variety of features 374 while maintaining lower levels of side wagers as a result of eligibility for the features 374 being activated one at a time in the auto-cycle 376.

The various auto-cycle features 376*a,b* of the system 300 may be configured so as to include or be associated with eligibility for different sets of features 374. Moreover, the various auto-cycle features 376*a,b* may be configured so as to have different eligibility cycling patterns. If an auto-cycle 376 contains three features 374, for example, a first auto-cycle feature 376 may cycle through eligibility for the features in a rotation (e.g., feature one, feature two, feature three, feature one, etc.) while a second auto-cycle feature 376 may cycle through eligibility for the features in a different pattern (e.g., feature one, feature two, feature one, feature three, feature one, etc.) Various auto-cycle features 376 may be created, stored, and made available to players via the menu 372. These various auto-cycle features 376 may be associated with various features 374 based upon wager size, theme, type of game play, etc. Moreover, the various auto-cycle features 376 may include labels, descriptions or graphics on the menu 372 so that players may quickly and easily understand the nature of the auto-cycle feature 376, the supplemental features 374 contained therein or associated therewith, and the pattern of cycling eligibility for the features 374 within the auto-cycle 376.

In yet other alternative embodiments, the auto-cycle features 376 may activate eligibility for more than one supplemental feature 374 at a time. For example, the auto-cycle 376 pattern may include activation of eligibility for first and second supplemental features 374 for a first play of the wagering game 360, and eligibility for third and fourth supplemental features 374 for a subsequent play of the wagering game 360. In this way, the auto-feature may be permitted to cycle eligibility for more than one feature 374 on any particular play of the wagering game 360.

In an embodiment, each of the features 374 enabled on the system 300 may have outcomes and triggering events that are independent of the outcomes on the primary wagering game 360. In other words, the features 374 may provide awards that are triggered independently of outcomes or awards in the primary wagering game 360. For example, independent features 374 include mystery triggered features, progressive jackpots, and time based trigger awards. In alternative embodiments, the features 374 may be dependent upon one or more outcomes in the primary wagering game 360. For example, a feature 374 may provide "free spins" or "extra selections" to a primary wagering game 360, thereby making the outcome of the feature 374 dependent on the outcomes of those spins or selections.

In alternative embodiments, the system 300 may change from eligibility for a first supplemental feature to eligibility for a second supplemental feature in response to other events or occurrences. For example, instead of changing eligibility in response to initiating a play of the primary wagering game 360 (pressing a "spin button" for example), the events that cause the change in eligibility may be independent of game play. In one embodiment, independent events such as a clock or other time frames may be used to set or drive the cycles of eligibility. In yet other embodiments, external inputs may be used to change or drive the cycling of eligibility in the auto-cycle features. For example, the system 300 may monitor rate of play, heartbeat, or other inputs and change or cycle eligibility accordingly in response thereto. Moreover, the auto-cycle changes of eligibility may be based upon point balances, player status, game levels, credit thresholds, etc. In yet other embodiments, events which cause the cycling of eligibility from one feature to the next may be embodied within certain game play. For example, the currently eligible feature may stay active until the feature is won by a particular player or someone within a defined group of players playing the system 300.

In yet other embodiments, the cycling of eligibility in the auto-cycle features may be dependent not only on the actions of one player, but on actions and results of a group of players, or even the entire community of players playing in the system 300. For example, groups of players may enroll or be grouped as teams or communities. Certain eligibility criteria may be evaluated across such groups to determine whether or not to cycle the eligibility from an active feature to the next feature in the cycle. Moreover, the pattern of cycling eligibility may be distributed across multiple players such that eligibility for a first active feature may be provided to a first player in the group, and then upon cycling, eligibility for the next feature may be provided to a second player in the group. Thus, the pattern of the auto-cycle feature may extend to different players as well as different features. Moreover, various events, levels, outcomes, totals, accumulations, successes, and/or failures of the group of players as a whole may affect the nature of the eligibility of the auto-cycle and to whom it is provided.

In yet another embodiment, a player may place multiple-coin side wagers on one or more of the selected activated features 374 in an effort to try to receive a larger payout should the feature 374 be triggered and provide an award or payout. For example, a player may be required to place at least a minimum side wager (e.g., one coin) to activate a particular feature 374. Once activated, if the feature 374 is triggered it may or may not provide a feature award as described previously herein. However, the player may also be permitted to place an optional multi-coin side wager on certain features 374, instead of a minimum (one-coin) side wager. For example, a player may place a three-coin side wager on a desired feature 374, and in return therefore receive a bonus enhancement or modifier. In some embodiments, the modifier may be a credit award (e.g., 500 additional credits), or a multiplier (e.g., 3× multiplier) if the feature is triggered and provides an award. Thus, if a feature 374 were triggered and awarded 250 credits, a player placing a standard one credit side wager on the feature 374 would receive the 250 credit feature award, while a player placing an increased 3-credit side wager on the same feature would receive a 3× multiplier, and thus a 750 credit payoff once the feature award was provided. In some embodiments, players may place side wagers on their side wagers to achieve such eligibility for such enhancements. Alternatively, players may place increased side bets as described.

In other embodiments, additional enhancements and modifiers may be provided to a player for placing increased or additional side wagers. Different enhancements may be provided based upon the nature of the game play and execution of the triggered feature 374. For example, if a feature 374 provides a player with a certain time eligibility to collect awards (e.g., collect all the awards you can collect in two minutes), the enhancement provided in exchange for the increased side wager may be additional time eligibility (three minutes instead of two). In another example, if the feature comprises receiving a series of free games or plays, the increased side wager may allow the player to receive additional free games or plays. In yet another example, if the feature comprises receiving a number of selections in a game, the increased side wager may provide an enhancement in the form of additional selections. Many other configurations are possible which allow a custom tailored enhancement to be provided within a feature 374 once triggered, assuming the player has placed a multi-coin or increased side wager on the feature 374. Thus, by providing an opportunity for players to make "greater-than-minimum" side wagers on features 374, games may provide enhancements to such players to compensate for the additional wagers received. Such increased side wagers may also be rewarded with an improved pay table such that features 374 triggered by certain multi-coin side bets receive an effectively higher expected value on awards paid out during such feature 374.

In yet other embodiments, players activating multiple features 374 at once (and thus posting multiple side wagers) may be rewarded with a discount for participating in multiple features 374. Thus, certain features 374 may be configured such that if the player activates a minimum number of features 374 simultaneously, he or she received group pricing or a discount. In one embodiment, a player activating at least ten (10) features 374 may do so for only nine (9) coins. In this way, the discount acts as a "Buy Nine Get One Free" pricing model as far as available features 374 are concerned. Many other group discounting models may be applied to such supplemental features 374, and may include internal eligibility rules as to which features 374 must be activated as precursors to being able to activate others.

In yet other embodiments, the enhancement that a player receives on a feature 374 may be based on other factors such as speed of play, size of wager, length of time on device, etc. For example, a player activating a feature by making a minimum side wager may be further eligible to receive an enhancement in the form of a multiplier thereto based upon such external factors. In one embodiment, the faster a player plays the primary wagering game, the greater his enhancement is (e.g., the greater multiplier he receives which is applied to a feature 374 if triggered). In one embodiment, the varying nature of the enhancement (e.g., multiplier) may be controlled by a time eligibility meter, as described in PCT Patent Publication WO 2006/121663, and U.S. Published Patent Application 2006/0135243, both of which are assigned to WMS Gaming Inc., and incorporated herein by reference in their entirety as if full set forth herein.

In such an embodiment, during each play of the wagering game, the time eligibility meter is increased in amount corresponding to and dependent upon (i) the size of the primary wager, (ii) the rate of play of the primary wagering game, or both. The time eligibility meter may include a plurality of multiplier levels such that the meter displays both a running time meter clock and a current multiplier level. Moreover, as time eligibility is accumulated in the meter, the multiplier levels may increase, and as time eligibility is expended through decrementing of the meter, the multiplier levels may decrease, as described therein. If a feature 374 were triggered and otherwise eligible for enhancement, a player may receive the enhancement (e.g., multiplier) as applied to the resulting feature award.

In yet other embodiments, the requirement that a player participate in the underlying primary wagering game may be removed. Thus, a player may be permitted to play by only placing side wagers on selected features 374 in an effort to be able to participate in such features 374 if and when triggered. Eligibility rules and criteria may be employed which control the number, amount and nature of side wagers that a player may be permitted to place on such features 374.

The system 300 as described and shown in various embodiments herein, offers a number of advantages over traditional systems. The bonus features available for activation of eligibility provide a player with a way to customize his gaming experience. Moreover, the auto-cycle features provide players with a way to alternate and/or cycle eligibility through a variety of features on successive plays of the wagering game, without having to manually activate eligibility for such features. The auto-cycling process further allows players to experience eligibility for a larger number of supplemental features, while at the same time saving the player money by only having to fund one side wager at a time (instead of activating eligibility for a plurality of features simultaneously which may require many separate side wagers) This provides players with a way to customize their gaming experience and to achieve additional enjoyment and excitement by experiencing a variety of supplemental features. Other benefits are provided in addition to those described herein.

Each of these embodiments and obvious variations thereof is contemplated as falling within the spirit and scope of the claimed invention, which is set forth in the following claims.

What is claimed is:

1. A computer-implemented method of operating a wagering game having cyclic eligibility for supplemental features, the method comprising:

receiving, via one or more input devices, a first wager to initiate a play of the wagering game;

receiving, via the one or more input devices, an auto-cycle activation input from a player to enable an auto-cycle feature associated with a plurality of supplemental features;

in response to receiving the first wager while the auto-cycle feature is enabled, activating, via one or more processors, a first eligibility period for triggering a first one of the plurality of supplemental features;

receiving, via the one or more input devices, a second wager to initiate another play of the wagering game; and in response to receiving the second wager while the auto-cycle feature is enabled, terminating, via the one or more processors, the first period and activating a second eligibility period for triggering a second one of the plurality of supplemental features.

2. The method of claim 1, wherein the auto-cycle feature cycles eligibility for the plurality of available supplemental features in accordance with a predetermined cycling pattern.

3. The method of claim 1, further comprising, in response to a first triggering event occurring during the first eligibility period, allowing the player to participate in the first one of the plurality of supplemental features.

4. The method of claim 3, further comprising, in response to a second triggering event occurring during the second eligibility period, allowing the player to participate in the second one of the plurality of supplemental features.

5. The method of claim 1, further comprising displaying a plurality of icons associated with the plurality of supplemental features.

6. The method of claim 1, wherein the another play of the wagering game is next in succession to the play initiated by the first wager.

7. The method of claim 1, further comprising displaying an auto-cycle icon associated with the auto-cycle feature.

8. The method of claim 7, further comprising highlighting the auto-cycle icon contemporaneously with activating the auto-cycle feature.

9. A gaming system comprising:

at least one input device;

at least one display device for displaying a wagering game;

one or more processors; and at least one memory device storing instructions that, when executed by the one or more processors, cause the gaming system to:

receive a first wager from a player to initiate a play of the wagering game;

detect an auto-cycle activation input from a player to enable an auto-cycle feature associated with a plurality of supplemental features;

in response to receiving the first wager while the auto-cycle feature is enabled, activate a first eligibility period for triggering a first supplemental feature of the plurality;

receive a second wager to initiate another play of the wagering game; and in response to receiving the second wager while the auto-cycle feature is enabled, terminate the first eligibility period and activate a second eligibility period for triggering a second supplemental feature of the plurality.

10. The system of claim 9, wherein the at least one display device further displays a first auto-cycle icon associated with the auto-cycle feature.

11. The system of claim 10, wherein the auto-cycle activation input is detected via a touch screen overlying the at least one display device.

12. The system of claim 9, wherein the instructions further cause the at least one display device to highlight a first supplemental feature icon during the first eligibility period, the first supplemental feature icon being associated with the first supplemental feature.

13. The system of claim 12, wherein the instructions further cause the at least one display device to highlight a second supplemental feature icon during the second eligibility period, the second supplemental feature icon being associated with the second supplemental feature.

14. The system of claim 9, wherein the at least one display device comprises a community display device, wherein one or both of the first and second supplemental features is displayed at least in part on the community display device.

15. The system of claim 9, wherein the another play of the wagering game is next in succession to the play initiated by the first wager.

16. The system of claim 9, wherein the instructions further cause the system to allow the player to participate in the first or second ones of the plurality of supplemental features in response to an occurrence of a first or second triggering event during the respective eligibility period.

17. The system of claim 9, wherein the instructions further cause the system debit, from a player credit balance, a first side wager associated with the first eligibility period and a second side wager associated with the second eligibility period.

18. A machine-readable, non-transitory medium including executable instructions that, when executed by one or more processors, cause a gaming device to perform a method comprising:

receiving, via one or more input devices, a first wager to initiate a first play of the wagering game;

receiving, via the one or more input devices, an auto-cycle activation input from a player to enable an auto-cycle feature associated with a plurality of supplemental features;

in response to receiving the first wager while the auto-cycle feature is enabled, activating, via the one or more processors, a first eligibility period for triggering a first one of the plurality of supplemental features;

receiving, via the one or more input devices, a second wager to initiate another play of the wagering game; and in response to receiving the second wager while the auto-cycle feature is enabled, terminating, via the one or more processors, the first period and activating a second eligibility period for triggering a second one of the plurality of supplemental features.

19. The medium of claim 18, wherein the first and second ones of the plurality are designated prior to initiating the first play of the wagering game.

20. The medium of claim 19, wherein the first and second ones of the plurality are designated by the player.

21. The medium of claim 18, wherein the method further comprises, in response to a first triggering event occurring during the first eligibility period, allowing the player to participate in the first one of the plurality of supplemental features.

22. The medium of claim 18, wherein the another play of the wagering game is next in succession to the play initiated by the first wager.

23. A gaming device configured to cycle eligibility for supplemental features with each successive play of a wagering game, the gaming system comprising:

at least one input device;

at least one display device for displaying the wagering game to a player;

one or more processors; and at least one memory device storing instructions that, when executed by the one or more processors, cause the gaming device to:

receive a first wager from the player to initiate a first play of the wagering game;

detect an auto-cycle activation input from the player to enable an auto-cycle feature, the auto-cycle feature cycling eligibility for one or more supplemental features of a plurality of supplemental features; and in response to receiving the first wager while the auto-cycle feature is enabled, activating a first eligibility period for triggering a first supplemental feature of the plurality;

in response to receiving a subsequent wager from the player, the subsequent wager initiating another play of the wagering game, terminating any previously activated eligibility period and activating a subsequent eligibility period for triggering a corresponding subsequent supplemental feature of the plurality, wherein the auto-cycle feature cycles the supplemental feature corresponding with each subsequent eligibility period according to a predetermined order of the supplemental features of the plurality.

24. The gaming device of claim 23, wherein the instructions further cause the gaming device to allow the player to participate in the first or other corresponding supplemental feature, in response to an occurrence of a triggering event during an activated eligibility period.

25. The gaming device of claim 23, wherein the predetermined order is selected by the player.

* * * * *